United States Patent [19]

Hancock

[11] 4,087,722

[45] May 2, 1978

[54] APPARATUS AND METHOD FOR SUPPLYING POWER TO GAS DISCHARGE LAMP SYSTEMS

[75] Inventor: Bruce J. Hancock, Mesa, Ariz.

[73] Assignee: American Ionetics, Inc., Miami, Fla.

[21] Appl. No.: 708,430

[22] Filed: Jul. 26, 1976

Related U.S. Application Data

[63] Continuation-in-part of Ser. No. 573,478, May 1, 1975, abandoned, which is a continuation-in-part of Ser. No. 451,362, Mar. 15, 1974, abandoned.

[51] Int. Cl.[2] ..... H05B 41/392; H05B 37/02

[52] U.S. Cl. ..... 315/200 A; 315/156; 315/219; 315/225; 315/DIG. 7; 331/113 S

[58] Field of Search ..... 315/155, 156, 158, 208, 315/209 R, 219, 225, 200 A, DIG. 7; 331/113 S

[56] References Cited

U.S. PATENT DOCUMENTS

| | | | |
|---|---|---|---|
| 3,430,102 | 2/1969 | Sidur | 315/200 A |
| 3,449,629 | 6/1969 | Wigert et al. | 315/158 X |
| 3,471,747 | 10/1969 | Gershen | 315/DIG. 7 |

*Primary Examiner*—Eugene R. LaRoche

*Attorney, Agent, or Firm*—Edwin M. Thomas

[57] ABSTRACT

The disclosed invention includes apparatus and method for full wave rectification of commerical alternating current of conventional or standard low frequency (e.g., 50–60 hz.) and for generating substantially square wave pulses of high frequency for transformation to voltage suitable for illumination of gas discharge lamps. The apparatus includes electronic means for rectification and silicone control rectifiers and stearing diodes, plus RC devices, for setting up a primary wave or pulse oscillation to produce a desired form of wave pulses at a suitable high frequency. Apparatus also includes variable potentiometer means for varying the lighting intensity by changing width or duty cycle of power pulses as applied to the primary of the light-operating transformer without substantially changing their frequency. Means which can be on or off also are included to periodically turn off the transformer power for "flashing" or periodic lighting and extinguishing of the lamps when such operation is needed. A unijunction and transistor combination can be switched on to periodically inhibit flow of power to the transformer and thereby produce the flashing action.

7 Claims, 5 Drawing Figures

APPARATUS AND METHOD FOR SUPPLYING POWER TO GAS DISCHARGE LAMP SYSTEMS

This application is a continuation in part of Ser. No. 573,478 filed May 1, 1975, now abandoned, which, in turn, was a continuation-in-part of application Ser. No. 451,362, filed Mar. 15, 1974, now abandoned.

BACKGROUND AND PRIOR ART

The operation of fluorescent and other gas discharge lamps and lamp systems for display lighting, large advertising signs, and the like by means of conventional power systems has many disadvantages. These include the need for expensive starting systems, the need for current limiting devices such as massive ballast, because of the negative conductive characteristics of gas discharge lamps, to prevent damage to lamps and other circuit components, etc., as is well known. Heavy currents may flow if not prevented and lamp systems of this type require protection against such after they have been started. Numerous proposals have been made in the past to solve these problems or prevent them from arising. Such proposals include schemes to operate the lamps by alternating current at much higher than normal commercial frequency, to reduce or eliminate the need for ballast. The use of special starting devices has been proposed in many instances, as in U.S. Pat. No. 3,500,125, which suggests use of high starting voltage for each cycle, while employing conventional power at 50 cycles or so. U.S. Pat. No. 3,471,747 suggests a system having a high voltage starter which is cut out for normal operation. In U.S. Pat. No. 3,354,350, it has been proposed to use multi-vibrators to break up conventional AC sine waves into high frequency pulses of approximately square wave form, employing such semiconductor devices as Zener diodes and transistors to divide the wave forms, etc. The purpose was to produce a much higher than normal frequency, which is also a purpose of the present invention, but the means used and the components involved are much more complex than in the present case. Other prior art investigators, as in U.S. Pat. No. 3,263,122, have suggested that one start initially with direct current, converting it by means of switching devices, including semi-conductor devices, to an alternating current of suitable high frequency. The amplitude of current in that case would be limited by special means to prevent damage to the lamps and other circuit components.

Still other proposals have included the use of specially configured transformers (U.S. Pat. Nos. 3,350,605 and 3,263,122) and various simple or more complex systems as in U.S. Pat. Nos. 3,368,107 and 3,639,827. In many of the devices of the prior art, semi-conductor elements of various types are used as triggering means, current limiting means and the like. Intermittent flashing means forcertain lights in combination with continuous power supply to others is suggested in Skirvin, U.S. Pat. No. 3,585,483.

The present invention is particularly concerned with improvements in apparatus and method for supplying power to light large illuminated signs to brightness which varies with ambient light conditions, although it is not limited to such use.

As far as applicant is aware, none of the devices or arrangements of the prior art are adapted for or suitable to use for the combination of the following functions, namely, (a) converting commercial AC power to high frequency AC of suitable wave form, (b) providing automatically for continuous readable illumination at minimum power consumption, brightness being variable with the ambient light as needed, and (c) interrupting and restarting the illumination periodically and repeatedly, when needed, as for flashing. The present invention has the accomplishment of these functions in combination as its major objective and a further objective is to do it all with simple and relatively inexpensive circuit components which are highly reliable.

A particular object of the present invention is to obtain essentially square wave DC pulse configuration at an optimum or near optimum high frequency which when converted back to AC will substantially eliminate the need for conventional ballast, i.e., to cut down size and weight of ballast required. Another object is to maintain control automatically over the width of pulses applied to the load, in response to ambient light conditions so as both to conserve power and to provide improved readability in display lighting. Many signs of this type are illuminated continuously at excessive brightness levels under ambient darkness conditions while often being inadequate when the ambient light is greater, as at twilight or in bright moonlight.

A further object is to make the sign capable optionally of intermittent or "flashing" operation, without substantially adding to the cost or complexity of the circuit components.

It has been proposed in the prior art to control or vary the brightness of lighting, by varying the timing of on and off portions of the power cycles in high frequency power systems. One such system is described in U.S. Pat. No. 3,619,716. However, the circuitry components therein required are numerous and complex and a further object of the present invention is to accomplish the desired result in a superior manner and with much simpler and less expensive equipment. The prior art apparatus mentioned, for example, requires multiple transformers, which are not needed in the present system.

Further objects of the invention are to operate banks of lamps, as in large display signs of illuminated type, with reduced overall power requirements, as compared with systems of the prior art. Light intensity is adjusted manually, automatically, or both, not only to reduce power consumption but also to improve readability under ambient light conditions. This may be accomplished preferably by use of simple and well known types of light-sensitive devices. Ambient light often varies widely from hour to hour as well as from day to day, so effective control over the power applied is important in reducing operating costs.

The foregoing and other objects will be more fully understood and appreciated by reference to a detailed description of a preferred embodiment which follows:

DESCRIPTION OF PREFERRED EMBODIMENT

Figures 1, 2, 3, 4, 5:
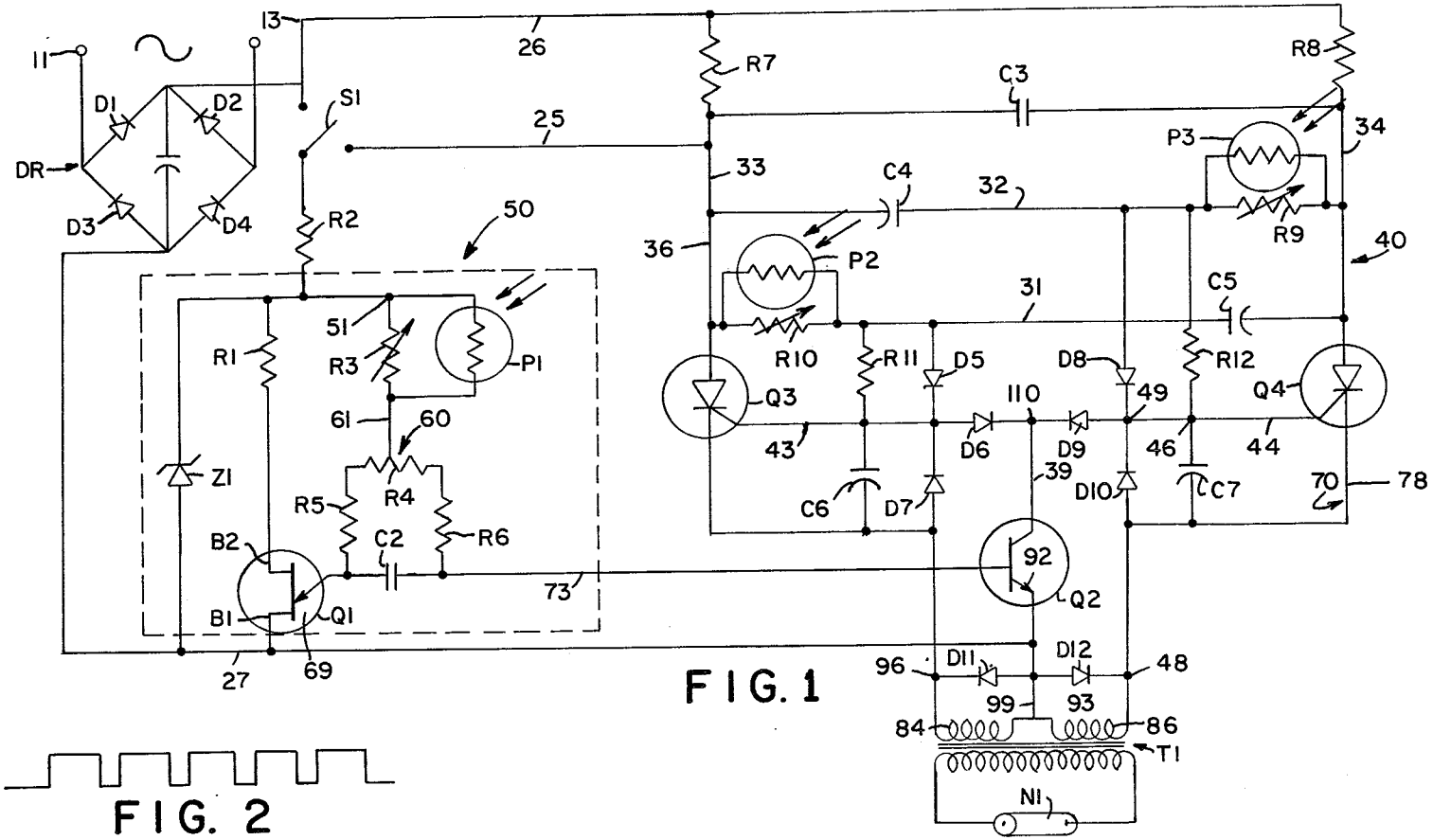
FIG. 1 is a circuit diagram of a preferred method and apparatus showing the combined simplified circuit components and their arrangement for supplying power to one or many lamps of gas discharge type.
FIG. 2 is a diagram of a wave form of high duty cycle suitable for giving a relatively high level of illumination.
FIG. 3 is a similar diagram representing a wave form of narrower pulse width, or lower duty cycle, suitable for lighting at reduced intensity.
FIG. 4 is a diagram of a wave form suitable for providing a flashing action with a relatively long "off" time.
FIG. 5 is a diagram showing dead time between pulses.

In FIG. 1, terminals 11 and 13 of a conventional alternating power source are shown, e.g., of conventional city power of 50 or 60 hz. and 110–120 up to 220 or more volts. This power is converted to direct current in a full wave rectifier of bridge type DR and supplied to leads 26 and 27. The diode bridge type rectifier comprising diodes $D_1$, $D_2$, $D_3$, and $D_4$, and a bridging capacitor $C_1$, is well known in the art and need not be described in detail. It does not, per se, constitute any part of the present invention.

Direct current is taken from the rectifier DR by the leads or bus bars 26, 27, the latter of which is grounded at 28, to several components of the circuit which will be described. A resistor $R_2$ connected to line 26, by switch $S_1$ which can be opened or closed manually applies voltage to a flash control system indicated generally at 50, at the left of FIG. 1. This will be described further below. Lead 26 is connected also to the upper terminals of two parallel resistors, $R_7$ and $R_8$. The opposite terminals of these resistors are connected across a commutating capacitor $C_3$. Commutating capacitor $C_3$ provides means for turning off one or the other of a pair of thyristors or SCR's, $Q_3$ or $Q_4$, whenever the opposite SCR turns on. Lead 25 connects $S_1$ with the output to produce the wave of FIG. 5.

The terminals of capacitor $C_3$ are connected through lines 33 and 34, respectively, to primary oscillating control circuitry indicated generally at 40 and to steering and stabilizing circuitry indicated generally at 70.

The circuitry 40 comprises lines 32 and 31, each of which includes a combination of capacitor and variable resistor means in series. This line 32 includes capacitor $C_4$ in series with a combination of a photocell or photoresistor $P_3$ and a parallel manually adjustable potentiometer or variable resistor $R_9$. Ambient light falling on $P_3$ changes its resistance value, hence, the total resistance in line 32 may be varied either by change in ambient light, or by manual adjustment of $R_9$, or both. Similarly, line 31 includes capacitor $C_5$ in series with the parallel combination of photoresistor $P_2$ and manually variable resistor $R_{10}$. These RC combinations, depending on the capacitance and resistance values, determine the frequency of the primary oscillator which produces the essentially square wave direct current pulses shown in FIGS. 2 and 3. See also, FIG. 5.

Under control of commutating capacitor $C_3$, the primary oscillator just described functions by alternately turning the SCR's $Q_3$ and $Q_4$ on and off. If the circuits or subcircuits of lines 31 and 32 have equal values of resistance and capacitance, the resulting wave form is a symmetrical square or essentially square wave. If one predominates, the positive pulses may be wider or narrower, compare FIGS. 2 and 3, to give higher or lower duty cycles. Thus the power delivered to the transformer $T_1$, as will be further described, is variable to control the intensity of lighting of the lamps $N_1$, by the transformer secondary 100. Changes in the ambient light, affecting the resistance of units $P_2$ and $P_3$, as well as different settings of the variable resistors $R_9$ and/or $R_{10}$, will affect the frequency output of the primary oscillator, more or less, but the variations in frequency may be compensated for, or approximately so, by setting one higher and the other lower. The preferred frequency for the primary oscillator circuit 40 is in the range of about 1,000 to 10,000 hz. Direct current pulses occurring alternately at $Q_3$ and $Q_4$ are transmitted respectively and alternately to the outer terminals of two primary windings of transformer $T_1$, as shown at 84 and 86, respectively. The inner terminals of the transformer primary are grounded to line 27 at 99. The respective DC pulses are picked up by the secondary winding 100 as alternating current to supply power to the lamp bank $N_1$.

To explain the operation further, line 33 at the left of unit 40 is connected through line 36 to the anode of the thyristor or SCR $Q_3$ and line 34 at the right is connected similarly through line 37 with the anode of the other SCR $Q_4$. The gate of SCR $Q_3$ is connected through resistance $R_{11}$ and diode $D_5$ to line 31, through extension 45 of gate 43. Similarly, the gate 44 of SCR $Q_4$ is connected to line 32 through $R_{12}$ and $D_8$ in parallel to help stabilize and direct the square wave direct current pulses to the transformer $T_1$. That is, the stabilizing circuitry comprises RC units in parallel with the respective SCR's. Unit 70 further comprises capacitor and diode means connecting gates 43 and 44, respectively, with the outputs of the SCR's. Thus, a capacitor $C_6$ and diode $D_7$ connect in parallel between the gate 43 of SCR $Q_3$ and its output line 71 which goes to the transformer winding 84 and capacitor $C_7$ and diode $D_{10}$ are connected in parallel between the gate 44 of SCR $Q_4$ and its output line 78 which connects to the outer terminal of primary winding 86 of the transformer.

The center tap 99 of the transformer primary windings is connected also to the emitter of a transistor $Q_2$ for a purpose described in detail below. Free wheeling diodes $D_{11}$ and $D_{12}$ are connected between the center tap of the transformer primary and the respective input lines 96 and 97, which connect respectively to outputs 71 and 78 of the two SCR's. The purpose of these diodes is to protect the semiconductor devices from voltage spikes which could occur due to surges in the transformer windings, as will be readily understood.

The square wave of FIG. 2 is shown at about the maximum duty cycle. With such a setting, the power supplied to the lamps $N_1$ is at or near a maximum for maximum or near maximum light brightness. By comparison, the wave form of FIG. 3 is set for a much lower duty cycle, so that the lights will be much less bright. The power is applied at such high frequency that there is no optical perception of the pulsating nature of the current supplied to the transformer in normal continuous operation.

However, as suggested above, it is often desireable to have the sign or other device flash off and on at rates that are distinctly visible. Warning signs often are operated in flashing mode and such operation is often desireable in display signs, or in components of such signs. The transistor Q2 and flashing control means 50 are provided for this purpose, according to the present invention, and these will next be described in detail. FIG. 4 shows graphically a typical flash timing cycle. Intervals between flashes may be as much as a second of time or several seconds, or even longer periods, if desired.

The flash control means 50, mentioned above and shown at the left of FIG. 1, comprises two major components for performing its function. It is operative, of course, only when swithch S1 is turned on. Unit 50 includes an RC circuit 60 designed to determine the on and off periods of flashing, i.e., the duty cycle of flashing. It comprises a Zener diode Z1 connected in series with a resistor R2 connected to switch S1. Z1 has its input connected to the ground line 27. Connected in parallel with the Zener diode is a line containing a resistor R1 and a unijunction transistor Q1. The emitter 69 of this unijunction device is connected by line 72 with a capacitor C2, the other terminal of which is connected by line 73 with the base of the transistor Q2 previously mentioned. Parallel resistors R5 and R6 are connected to opposite sides of the capacitor C2, their upper terminals being joined by a voltage divider R4. This combination of resistors, voltage divider and capacitor C2, constitutes the unit 60 which sets up an ocillation at a rate suitable for flashing the lights N1 on and off. An adjustable contact 61 for the voltage divider R4 is connected to a variable resistor-photoresistor combination R3, P1, which is similar in arrangement and function to the units P3, R9, and P2, R10, already described. The photorsistor P1, like P2 and P3, is subject to variation in resistance on impact of varying ambient light. Thus, the unit R3–P1 can be used to further vary the intensity of light at the flashing mode. In some cases, this unit, R3–P1, may be omitted.

When the flasher 50, 60, is operating, the transistor Q2 is turned on and off, periodically. Since the Zener diode sets the working voltage of this part of the circuit, and the values of resistors R5 and R6 are fixed and not variable, it follows that the rate at which the capacitor C2 is charged in either direction depends largely upon the setting of the voltage divider R4, although the charging rate is secondarily dependant on the setting potentiometer or variable resistor R3. The circuit 50, 60 produces an output connected to the base of transistor Q2, to control its functioning, which will next be explained.

After the capacitor C2 is charged it discharges to drive the base of transistor Q2 to conduction (saturation). When transistor Q2 then conducts, there is no power supplied to the transformer primary windings 84 or 86. This is because the gates 43 and 44 respectively of Q3 and Q4 are grounded. The capacitor C2 sees ground through the transistor Q2 and is discharged. Thereupon, unijunction Q1 returns to its normal nonconductive state. Under this condition, current for flashing control through resistors R2, R3, part of R4, and R5 to charge capacitor C2 from the left.

The time required to charge capacitor C2 in either direction depends in part on its characteristics and also, as stated above, on the values of resistors R5, R6, the settings of voltage divider R4 and of potentiometer R3 and photoresistor P1. These latter settings then will determine both the flash rate and the duty cycle of the resulting output, as shown in FIG. 4. When transistor Q2 is deprived of power at its base, it becomes non-conductive like an open switch. Current then flows through SCR output leads 71 and 78 to the transformer in the usual manner through lines 96 and 97. The voltage applied to the transistor base, Q2, changes in one direction or the other as capacitor C2 is charged or discharged. The relative rates, of charging capacitor C2 from right or left is determined by circuitry 50, 60 and thus determines the relative widths of the wave pulses, FIG. 4.

It will be obvious that variations and modifications may be made in the circuitry or apparatus and in the method of applying it to interior lighting, illuminated signs, gaseous discharge lamps and the like without departing from the spirit and purpose of the invention. It is desired by the claims which follow to cover all such variations, changes, modifications and substitutions as would readily occur to those skilled in the art, as well as the actual specific details specifically disclosed, as broadly as the state of the art properly permits.

What is claimed is:

1. Apparatus for supplying variable power to a discharge gas lamp load to vary the brightness in lamp elements of said load which includes, in combination:

(a) Means for rectifying commercial alternating current of relatively low frequency to obtain a direct current supply;

(b) A primary oscillator for converting said direct current supply to high frequency substantially square wave pulses;

(c) A transformer having a primary winding for receiving said pulses and a secondary winding for supplying alternating current from said pulses to said lamp load;

(d) Means for conducting said pulses to the transformer primary winding, including a pair of alternatly conducting Silicone Control Rectifiers, and (e) A control circuit including means responsive to variations in ambient light for selectively changing the width of said pulses by controlling the on and off times of said Silicone Control Rectifiers, thereby to vary and control the power conducted to said transformer in response to said variations in said ambient light.

2. Apparatus according to claim 1 which includes capacitor means and variable resistance means for selectively changing the pulse widths.

3. Apparatus according to claim 1 which includes a secondary oscillator for periodically starting and stopping the flow of said pulses to said transformer for the purpose of flashing lamp elements in said lamp load.

4. Apparatus according to claim 1 which includes both a secondary oscillator for causing said lamp elements to flash periodically and a variable potentiometer for changing the duty cycle of said pulses for further varying the brightness of said lamp elements.

5. Apparatus according to claim 1 in which the commutating capacitor is included for alternately turning on said Silicone Control Rectifiers.

6. The method of supplying power to light lamp elements in a gas discharge lamp load which comprises the following steps, in combination:

(a) Rectifying commercial alternating current and passing the resulting direct current to a primary oscillating circuit, (b) Establishing in said primary oscillating circuit an oscillation of frequency higher than that of said commercial current to produce substantially square wave direct current pulses, (c) Selectively controlling the width of said square wave pulses for compatability with varying ambient light conditions by alternately controlling the on and off times at alternate pulse-forwarding stations, (d) Forwarding the width-controlled direct current pulses to a transforming station, (e) At said transforming station converting said pulses to alternating current and applying said alternating current to said lamp elements, thereby lighting said lamp elements to a brightness controlled in relation to said ambient light, and (f) Periodically inhibiting flow of said direct current pulses to said transformer station to cause intermittent flashing of said lamp elements.

7. A method according to claim 6 which includes the step of varying the width of said direct current pulses manually.

* * * * *